US005286622A

United States Patent [19]

Waki

[11] Patent Number: 5,286,622

[45] Date of Patent: Feb. 15, 1994

[54] LIGHT-SENSITIVE ELEMENT FOR SILVER SALT DIFFUSION TRANSFER METHOD

[75] Inventor: Koukichi Waki, Kanagawa, Japan

[73] Assignee: Fuji Photo Film Co., Ltd., Kanagawa, Japan

[21] Appl. No.: 54,981

[22] Filed: Apr. 30, 1993

[30] Foreign Application Priority Data

Apr. 30, 1992 [JP] Japan ..... 4-111637

[51] Int. Cl.[5] ..... G03C 5/54; G03C 1/02

[52] U.S. Cl. ..... 430/567; 430/230; 430/569; 430/599

[58] Field of Search ..... 430/230, 567, 599, 569

[56] References Cited

U.S. PATENT DOCUMENTS

| | | | |
|---|---|---|---|
| 3,206,313 | 9/1965 | Porter et al. | 430/599 |
| 4,444,877 | 4/1984 | Koitabashi et al. | 430/567 |
| 4,614,711 | 9/1986 | Sugimoto et al. | 430/567 |
| 4,623,612 | 11/1986 | Nishikawa et al. | 430/567 |
| 4,636,461 | 1/1987 | Becker et al. | 430/567 |
| 4,713,318 | 12/1987 | Sugimoto et al. | 430/567 |
| 5,206,115 | 4/1993 | Waki | 430/230 |

*Primary Examiner*—Richard L. Schilling
*Attorney, Agent, or Firm*—Sughrue, Mion, Zinn, Macpeak & Seas

[57] ABSTRACT

There is disclosed the light-sensitive element having a high sensitivity and capable of forming a transferred image with a small fluctuation in a sensitivity and a gradation. The light-sensitive element which is processed by a silver salt diffusion transfer method comprising developing a light-sensitive element having a light-sensitive silver halide emulsion layer subjected to an imagewise exposure with an alkaline processing element containing a silver halide solvent to convert at least a part of unexposed silver halide contained in the emulsion layer to a transferable silver complex salt, and transferring at least a part of the complex salt on an image-receiving element to form the image on the image-receiving element contains the silver halide grains which are of silver bromoiodide or silver bromochloroiodide having the following constitutions (a), (b), (c) and (d), in the light-sensitive silver halide emulsion layer:

(a) the grain consists of a core (a nucleus) and plural layers of a shell;

(b) an addition amount of iodide in forming the core is 0 to 1 mole %; an addition amount of iodide in forming the first layer shell is 60 to 100 mole %; and the total addition amount of iodide in forming the sell on and after the second layer is 0 to 2 mole %;

(c) an average silver iodide content of the whole grain including the core and shell is 0.5 to 4.5 mole %; and (d) silver bromoiodide having a silver iodide content of 2 to 8 mole % is deposited on the grain surface after chemical sensitization in an amount corresponding to 1 to 10% by weight (in terms of silver amount) of the silver halide grains formed before chemical sensitization.

6 Claims, No Drawings

LIGHT-SENSITIVE ELEMENT FOR SILVER SALT DIFFUSION TRANSFER METHOD

FIELD OF THE INVENTION

The present invention relates to an image forming method using a silver salt diffusion transfer and a light-sensitive element used therefor.

BACKGROUND OF THE INVENTION

At present, the silver salt diffusion transfer method is well known in the art and, as a result, a description thereof will be brief. The details thereof are described in A. Rott and E. Weyde, "Photographic Silver Halide Diffusion Processes", Focal Press Co. (1972); J. Sturge, V. Walworth and A. Shepp, "Imaging Processes and Materials: Neblette's Eighth Edition", Chapter 6, Instant Photography and Related Reprographic Processes, published by Van Nostrand Reinhold Co. (1989); and G. Haist, "Modern Photographic Processing Vol. 2", Chapter 8, Diffusion Transfer, John Wiley and Sons Co. Many kinds of photographic materials can be prepared by this diffusion transfer method, which are described in detail in the above publications. It is known, for example, that a light-sensitive element comprising a silver halide emulsion coated on a support and an image-receiving element containing silver precipitate nuclei are superposed and a processing element consisting of a high viscosity alkaline processing composition containing a developing agent and a silver halide solvent is spread between the above two elements, whereby a transferred image can be obtained.

In the above constitution, after the light-sensitive element is exposed, it is superposed on the image-receiving element and the processing element is spread therebetween and they are separated after a fixed time, whereby a transferred image can be obtained on the image-receiving element. It is always desired to complete the formation of this transferred image in less time.

Methods for accelerating the completion of the transferred image include a method in which a high reductive compound such as a hydroquinone is used as a developing agent and a solvent having a fast dissolving speed such as hypo is used as a silver halide solvent, and a method in which silver chloride and silver brmochloride each with a high solubility are used for a silver halide emulsion present in the light-sensitive element. In the former method, however, the transferred image is very instable and the image can not be stored for a long period of time because of the generation of stain by the oxidation product of a developing agent and the sulfurization by residual hypo present.

In order to prevent this, an anti-oxidation layer such as polyvinyl alcohol containing an alkaly neutralizing agent needs to be coated on the surface of the image immediately after completing the image, which complicates handling. The latter method has the disadvantage that it can not be used as a photograph because of low sensitivity and because the density of the transferred image is reduced since fog is tends to be formed.

Meanwhile, it is strongly desired for the fluctuation in the photographic properties to be small under various use conditions and particularly it is desired that the fluctuation due to temperature of use is small.

In the above two methods, temperature of use dependency tends to deteriorate.

SUMMARY OF THE INVENTION

An object of the present invention is to provide a light-sensitive element having a high sensitivity and a fast image completion and capable of forming a transferred image with small fluctuation in sensitivity and gradation.

The above object is achieved by a light-sensitive element processed by a silver salt diffusion transfer method comprising developing a light-sensitive element containing a light-sensitive silver halide emulsion layer subjected to an imagewise exposure with an alkaline processing element containing a silver halide solvent to convert at least a part of the unexposed silver halide present in the emulsion layer into a transferable silver complex salt, and transferring at least a part of the complex salt onto an image-receiving element including a silver precipitate nucleus-containing image-receiving layer to form an image on the image-receiving element, wherein the silver halide grains present in the light-sensitive silver halide emulsion layer comprise silver bromoiodide or silver bromochloroiodide with the following characteristics (a), (b), (c) and (d):

(a) the grains comprise grains of a core (a nucleus) and plural shell layers;

(b) the amount of iodide present in forming the core is 0 to 1 mole %; the amount of iodide present in forming the first layer shell is 60 to 100 mole %; and the total amount of iodide present for forming the shell layers after the first layer shell is 0 to 2 mole %;

(c) the average silver iodide content of the entire grain including the core and shell is 0.5 to 4.5 mole %; and (d) silver bromoiodide having a silver iodide content of 2 to 8 mole % is deposited on the grain surface after chemical sensitization in an amount corresponding to 1 to 10% by weight (in terms of silver amount) of the silver halide grains formed before chemical sensitization.

The number of layers of the core and shell in the present invention is the same as the number of regions with a different silver iodide content. The ratio of the core to the shell may be varied. In order to sufficiently demonstrate the effect of the first layer shell, the weight ratio of the core to the entire shell layers is preferably from 80:20 to 20:80, more preferably from 65:35 to 35:65, in terms of silver amount.

In the present invention, the average silver iodide content of the entire silver halide grain (including silver bromoiodide deposited on the grain surface after chemical sensitization) is preferably 1.0 to 3.5 mole %, more preferably 1.5 to 3.0 mole %. The silver chloride content thereof may be varied. From the viewpoint of sensitivity and fog, the silver chloride content is preferably 1 mole % or less on the average.

The amount of iodide in the core according to the present invention should be decreased as much as possible in order to narrow the grain size distribution and improve temperature of use dependency. In the present invention, it is generally 0 to 1.0 mole %, preferably 0 to 0.5 mole %, more preferably 0 mole %.

In the first layer shell of the present invention, silver bromoiodide is formed by recrystallization either using a procedure in which silver nitrate and potassium iodide are added or a procedure in which only potassium iodide is added. It is known that the maximum content of silver iodide in forming mixed crystals of silver bromoiodide is about 40 mole %.

Silver bromoiodide formed on the surface after chemical sensitization is an effective means for achieving a high sensitivity without delaying dissolving speed. The amount of the silver bromoiodide to be formed on the surface grain after chemical sensitization is an amount corresponsing to 1 to 10%, particularly 3 to 8%, of the silver halide grains formed before chemical sensitization (in terms of silver amount). The sensitivity is reduced if this silver amount is either too small or too large and the effect can not be revealed. The silver iodide content in silver bromo-iodide present on the surface is preferably 3 to 6 mole %. An excessive silver iodide content delays dissolving speed, which results in retarding the completion of the transferred image. Methods for forming silver bromoiodide on the grain surface include a method in which silver ion and halogen ion are added after chemical sensitization, a method in which a silver bromoiodide fine grain emulsion is added to allow silver bromoiodide to be recrystallized on host grain by Ostwald ripening, and a method in which a silver bromide fine grain emulsion and a potassium iodide aqueous solution are mixed to allow silver bromoiodide to be recrystallized on the host grain by Ostwald ripening.

In the present invention, the boundary area present between the core and shell and having a different halogen composition may be either a distinct boundary or an indistinct boundary in which mixed crystal is formed, or a boundary which is provided with an intentionally continuous compositional change.

The silver halide grains according to the present invention may be either grains in which a latent image is formed primarily on the surface thereof or grains in which a latent image is formed primarily in the inside thereof, or grains in which a latent image is not localized in any of them. In particular, grains in which the latent image is formed at a position at which the maximum sensitivity is exhibited under the following condition are preferred: a latent image position confirming condition—a sample comprising a silver halide emulsion coated on a polyethylene terephthalate film in the amount of 1 g/m$^2$ as silver and a gelatin protective layer provided thereon is exposed and then developed in a processing solution of MAA-1+hypo 0.3 g/l at 20° C. for 20 minutes.

The silver halide grains according to the present invention may have a regular crystal form such as a cube and an octahedron, an irregular crystal form such as a sphere and a plate, and a composite form of these crystal forms.

A tabular silver halide grain is preferred in the present invention in order to obtain a light-sensitive element with high sensitivity and a rapid transfer speed. The tabular grains has a relatively large surface area compared with those of the other grains and therefore is advantageous in terms of light absorption and dissolving speed.

The average size (represented by the diameter of a circle having an area corresponding to the projected area) of the silver halide grains according to the present invention is not specifically limited. The average size is preferably 4 μm or less, more preferably 3 μm or less, and particularly preferably 0.2 to 2 μm. The grain size distribution may be either narrow or broad.

The emulsion used in the present invention can be prepared using the methods described in P. Glafkides, *Chimie et Physique Photographique*, Paul Montel Co., Ltd. (1967); G. F. Duffin, *Photographic Emulsion Chemistry*, The Focal Press Co., Ltd. (1966); and V. L. Zelikman et al, *Making and Coating Photographic Emulsions*, The Focal Press Co., Ltd. (1964). That is, any of an acid method, a neutral method and an ammonia method may used, and the manner of reacting a soluble silver salt with a soluble halide may be a single mixing method, a double jet method and the combination thereof. A method of forming the silver halide grains in the presence of an excessive silver ion (the so-called reverse mixing method) can be used. A method in which the pAg of a solution in which silver halide is prepared is maintained at a fixed level, that is, a controlled double jet method can be used as one form of the double jet method. A silver halide emulsion consisting of silver halide grains with a regular crystal form and a substantially uniform grain size can be obtained with this method. For example, the technique described in U.S. Pat. No. 4,797,354 can also be used.

Various polyvalent metal ion compounds can be incorporated into the silver halide emulsion used in the present invention in the course of an emulsion grain formation or a physical ripening. Examples of the compounds used include the salts of cadmium, zinc, lead, and thallium, and the salts or complex salts of iron, iridium, ruthenium, rhodium, palladium, osmium, and platinum, each of the VIII group. In particular, the elements of the VIII group can be advantageously used. The amount of these compounds present can be varied over a wide range depending on the objects and is preferably $10^{-9}$ to $10^{-4}$ mole per mole of silver halide.

Chemical sensitization of the silver halide emulsion according to the present invention can be conducted by the methods described in the above publications by Glafkides, Duffin and Zelikman, and *Die Grundlagen der Photographischen Prozesse mit Silberhalogeniden*, H. Frieser, Ed. Akademische Verlagsgesellschaft (1968).

That is, a sulfur sensitization method in which active gelatin and compounds containing sulfur capable reacting with silver (for example, thio-sulfate, thioureas, mercapto compounds, and rhodanines); a noble metal sensitization method in which noble metal compounds (for example, in addition to gold complex salts, the complex salts of metals of VIII group of the periodic table such as platinum, iridium and palladium) are used; and a reduction sensitization method in which reductive materials (for example, a stannous salt, amines, a hydrazine derivative, formamidinesulfinic acid, and a silane compound) are used, can be used alone or in combination.

Preferred spectral sensitizer which can be used for the silver halide emulsion according to the present invention are cyanine dyes, merocyanine dyes, composite cyanine dyes, composite merocyanine dyes, holopolar-cyanine dyes, hemicyanine dyes, styryl dyes, and hemioxanol dyes. Particularly useful dyes are cyanine dyes, merocyanine dyes, and composite merocyanine dyes. Specific examples thereof are described in F. M. Hamer, *Heterocyclic Compounds-Cyanine Dyes and Related Compounds*, John Wiley and Sons Co. (1964). In addition thereto, the spectral sensitizers described in U.S. Pat. Nos. 2,493,748, 2,519,001, 2,977,229, 3,480,434, 3,672,897, 3,703,377, 2,688,545, 2,912,329, 3,397,060, 3,615,635, and 3,628,964, British Patents 1,195,302, 1,242,588, and 1,293,862, German Patent Applications (OLS) 2,030,326 and 2,121,780, JP-B-43-4936 (the term "JP-B" as used herein means an examined Japanese patent publication), JP-B-44-14030, and JP-B-43-10773, U.S. Pat. Nos. 3,511,664, 3,522,052, 3,527,641, 3,615,613, 3,615,632, 3,617,295, 3,635,721, and 3,694,217, British Patents 1,137,580 and 1,216,203 can also be used.

The spectral sensitizers can be used as a combination as described in JP-A-59-114533 (the term "JP-A" as used herein means an unexamined published Japanese patent application) and JP-A-61-163334.

The layer structure comprising a support having a subbing layer provided on both sides of a polyethylene terephthalate film containing titanium dioxide or carbon black; and thereon a light-sensitive silver halide emulsion layer on one side thereof and a protective layer there-on; and further a carbon black layer on the other side thereof and a protective layer thereon is advantageously used in the light-sensitive element of the present invention.

In addition to the above layer structure, a preferred light-sensitive element comprises a titanium oxide layer provided on one side of a support having subbing layers on the both sides of a polyethylene terephthalate film containing titanium dioxide or carbon black, a light-sensitive silver halide emulsion layer provided thereon, a protective layer further provided thereon, a carbon black layer provided on the other side of the support, and a protective layer provided thereon. Further, a colored dye can be used in place of or in addition to the carbon black described above.

Where the carbon black and/or colored dye is present in the polyethylene terephthalate, a layer containing the carbon black and/or colored dye does not need to be provided on the other side of the support. The titanium oxide described above may be replaced with other white pigments, if desired.

In addition to the above polyester support, paper laminated with polyethylene, baryta paper and cellulose triacetate can be used as the support for the light-sensitive element.

The total thickness of the layers on the silver halide emulsion layer side of the support in the light-sensitive element of the present invention is preferably from 0.5 to 8.0 $\mu$m, more preferably from 1.0 to 6.0 $\mu$m, and the amount of the silver halide grains coated is preferably from 0.1 to 3.0 g/m$^2$, more preferably from 0.2 to 2.0 g/m$^2$ as silver.

In order to make the present invention more effective, various compounds can be incorporated into a light-sensitive silver halide emulsion layer for the purposes of preventing fog in preparing, storing and photographically processing a light-sensitive material and stabilizing the photographic properties.

Well known anti-fogging agents and stabilizers such as azoles (for example, a benzothiazolium salt, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, nitrobenzotriazoles, and benzotriazoles), mercaptopyrimidines, mercaptotriadines, a thioketo compound, azaindenes (for example, triazaindenes, tetraazaindenes, and pentaazaindenes), benzenesulfonic acids, benzenesulfinic acids, benzenesulfonic amides, and $\alpha$-lipoic acid can be advantageously used as these compounds. Representative examples thereof include 1-phenyl-2-mercaptotetrazole, 4-hydroxy-6-methyl-1,3,3a,7-tetrazaindene, 2-mercaptobenzothiazole, and 5-carboxybutyl-1,2-dithiolane.

Further, U.S. Pat. No. 3,982,947 and JP-B-52-28660 can be referred to for more detailed examples thereof and methods of use thereof.

An inorganic or organic hardener can be incorporated into the light-sensitive element of the present invention. There can be used alone or in combination, for example, a chromium salt (chromium alum and chromium acetate), aldehydes (formaldehyde, glyoxal, and glutaraldehyde), an N-methylol compound (dimethylolurea and methyloldimethylhydantoin), a dioxane derivative (2,3-dihydroxydioxane), an active vinyl compound (1,3,5-triacryloyl-hexahydro-s-triazine), and a mucohalogenic acid (mucochloric acid and mucophenoxychloric acid). A coating aid can be used for the silver halide emulsion layer and other hydrophilic colloid layers in the light-sensitive element of the present invention. Suitable coating aids include the compounds described in "Coating aids", Research Disclosure, Vol. 176, 17643, p. 26 (December 1978), and the compounds described in JP-A-61-20035.

The silver halide emulsion layer and other hydrophilic colloid layers in the light-sensitive element of the present invention can include, for example, polyalkylene oxide or the ether, ester and amine derivatives thereof, a thioether compound, thiomorpholines, a quaternary ammonium compound, a urethane derivative, a urea derivative, an imidazole derivative, and 3-pyrazolidones for the purposes of increase in sensitivity, improvement in contrast and acceleration in development. Examples of such compounds include the compounds described in U.S. Pat. Nos. 2,400,532, 2,423,549, 2,716,062, 3,617,280, 3,772,021, and 3,808,003.

A dispersion of a water insoluble or sparingly soluble synthetic polymer can be incorporated into the silver halide emulsion layer and other hydrophilic colloid layers in the light-sensitive element of the present invention for the purpose of the improvement in dimensional stability. For example, polymers comprising monomer components, as single components or combination thereof, such as alkyl (meth)acrylate, alkoxyalkyl (meth)acrylate, glycidyl (meth)acrylamide, vinyl ester (for example, vinyl acetate), acrylonitrile, olefin, and styrene, or the combination of acrylic acid, methacrylic acid, $\alpha,\beta$-unsaturated dicarboxylic acid, hydroxyalkyl (meth)acrylate, and styrenesulfonic acid therewith can be used.

The silver halide emulsion layer used in the light-sensitive element of the present invention may comprise plural layers. Further, a protective layer may be provided on the silver halide emulsion layer. This protective layer comprises a hydrophilic polymer such as gelatin and can contain a matting agent and a sliding agent each described in JP-A-61-47946 and JP-A-61-75338.

A dye and a UV absorber may be incorporated into the silver halide emulsion and other hydrophilic colloid layers of the light-sensitive element of the present invention for the purpose of a filter and an anti-irradiation.

In addition, the light-sensitive element can contain an anti-charging agent, a plasticizer, and an anti-aerial fogging agent.

It is advantageous to use gelatin as the hydrophilic binder used in the light-sensitive element of the present invention but hydrophilic binders other than gelatin can be used as well. For example, proteins (gelatin derivatives, graft polymers of gelatin with other polymers, albumin, and casein), cellulose derivatives (hydroxyethyl cellulose, carboxymethyl cellulose, and cellulose sulfuric acid esters), sugars (sodium alginate and a starch derivative), and synthetic hydrophilic polymers (a homopolymer or copolymer of polyvinyl alcohol, partially acetalized polyvinyl alcohol, poly-N-vinylpyrrolidone, polyacrylamide, polyvinylimidazole, and polyvinylpyrazole) can be used.

In addition to lime-treated gelatin, acid-treated gelatin and enzyme-treated gelatin described in *Bull. Soc. Sci. Phot. Japan*, No. 16, pp. 30 (1966) may be used as gelatin, and the hydrolysis product and enzyme decomposition products of gelatin can be used as well.

Also, compounds obtained by reacting gelatin with an acid halide, an acid anhydride, isocyanates, bromoacetic acid, alkane sultones, vinylsulfonamides, maleinimide compounds, polyalkylene oxides, and epoxy compounds can be used as gelatin derivatives. Specific examples thereof are described in U.S. Pat. Nos. 2,614,928, 3,132,945, 3,186,846, and 3,312,553, British Patents 861,414, 1,033,189, and 1,005,784, and JP-B-42-26845.

The product obtained by grafting a homopolymer or copolymer of a vinyl series monomer such as acrylic acid, methacrylic acid, acrylic acid ester, acrylamide, acrylonitrile, and styrene to gelatin can be used as a gelatin graft polymer. Specific examples thereof are described in U.S. Pat. Nos. 2,763,625, 2,831,767, and 2,956,884.

The image-receiving element in the present invention is coated on a support having thereon with an image-receiving layer containing a silver precipitate nucleus, for example, baryta paper, polyethylene-laminated paper, cellulose triacetate, or a polyester compound. Such an image-receiving element can be prepared preferably by covering the support subbed as necessary with a cover solution of a suitable cellulose ester, for example, cellulose diacetate, containing the silver precipitate nucleus dispersed therein. The cellulose ester layer thus obtained is subjected to an alkali hydrolysis to convert at least a part of the cellulose ester in the depth direction to cellulose. In a particularly useful specific example thereof, cellulose ester present in the silver precipitate nucleus layer (image-receiving layer) and/or a lower layer which is not subjected to hydrolysis, for example, the part, which is not subjected to hydrolysis, of the cellulose ester layer containing cellulose diacetate, contains one or more kinds of mercapto compound which is suitable for improving the color tone and stability of a silver transfer image and other photographic properties. Such a mercapto compound is utilized dispersing during an inhibition from the position at which this is initially placed. The image-receiving element of this type is described in U.S. Pat. No. 3,711,283.

Preferred as the above mercapto compound are the compounds described in JP-A-49-120634, JP-B-56-44418, British Patent 1,276,961, JP-B-56-21140, and JP-A-59-231537 and JP-A-60-122939.

Specific examples of silver precipitate nuclei include a heavy metal, for example, iron, lead, zinc, nickel, cadmium, tin, chromium, copper, and cobalt, and further a noble metal, for example, gold, silver, platinum, and palladium. Examples of other useful silver precipitate nuclei are sulfides and selenides of heavy metals and noble metals, in particular, the sulfides and selenides of mercury, copper, aluminum, zinc, cadmium, cobalt, nickel, silver, lead, antimony, bismuth, cerium, magnesium, gold, platinum, and palladium. In particular, gold, platinum and palladium, or the sulfides thereof are preferred.

A neutralization acid polymer layer (an alkali neutralization layer) is preferably provided between the non-saponified layer (a timing layer) and support. A polymer acid described in, for example, U.S. Pat. No. 3,594,164 is used. Preferred as the polymer acid is a maleic anhydride copolymer (for example, a styrene-maleic anhydride copolymer, a methyl vinyl ether-maleic anhydride copolymer, and an ethylene-maleic anhydride copolymer), and a (meth)acrylic acid (co)-polymer (for example, an acrylic acid-alkyl acrylate copolymer, an acrylic acid-alkyl methacrylate copolymer, a methacrylic acid-alkyl acrylate copolymer, and a methacrylic acid-alkyl methacrylate copolymer).

In addition to the above, useful polymers include those containing sulfonic acid, such as polyethylenesulfonic acid, and the acetal compound of benzaldehyde-sulfonic acid and polyvinyl alcohol.

Further, the neutralization layer may contain the mercapto compounds used in the timing layer. These polymer acids and a hydrolyzable alkali non-permeable polymer (in particular the above cellulose ester is preferred) or an alkali permeable polymer may be mixed for the purpose of improving a layer physical property.

The image receiving element preferably has an image stabilizing layer for improving image preservability, and a cationic high molecular weight electrolyte is preferred as a stabilizer therefor. Particularly preferred as the cationic high polymer electrolyte are the water-dispersed latexes described in JP-A-59-166940, U.S. Pat. No. 3,958,995, and JP-A-55-142339, JP-A-54-126027, JP-A-54-155835, and JP-A-53-30328, the polyvinyl pyridinium salts described in U.S. Pat. Nos. 2,548,564, 3.148,061, and 3,756,814, the water soluble quaternary ammonium salt polymers described in U.S. Pat. No. 3,709,690, and the water insoluble quaternary ammonium salt polymers described in U.S. Pat. No. 3,898,088.

Cellulose acetate is preferred as the binder for the image stabilizing layer. In particular, cellulose diacetate having a degree of acetylation of 40 to 49% is preferred. This image stabilizing layer is provided preferably between the above neutralization layer and timing layer.

An acid polymer (for example, a copolymer of methylvinyl ether and maleic anhydride and a copolymer of methylvinyl ether and maleic anhydride half ester) can be incorporated into the timing layer for the purposes of preventing an increase in timing time due to the change of cellulose ester on storage over a long period of time and shortening the timing time.

Further, a white pigment (for example, titanium dioxide, silicon dioxide, kaolin, zinc dioxide, and barium sulfate) can be incorporated into the timing layer and neutralization layer for the purpose of preventing light from entering the interior thereof in a cross-sectional direction (light piping).

Further, a plasticizer may be incorporated into the timing layer and neutralization layer for the purpose of improving curling and fragility. Well known compounds can be used as plasticizers.

An intermediate layer may be provided between the image-receiving layer and timing layer. A hydrophilic polymer such as gum arabic, polyvinyl alcohol, and polyacrylamide can be used for the intermediate layer.

A separating layer is preferably provided on the surface of the image-receiving layer in order to prevent processing solution from adhering to the surface of the image-receiving layer in separating after spreading the processing solution.

Preferred compounds for the separating layer are the compounds described in U.S. Pat. Nos. 3,772,024 and 3,820,999, and British Patent 1,360,653 as well as gum arabic, hydroxyethyl cellulose, carboxymethyl cellulose, polyvinyl alcohol, polyacrylamide, and sodium alginate.

Preferred light shielding methods are a method in which a light shielding agent (for example, carbon black and an organic black pigment) is incorporated into a paper for a support, and a method in which the above described light shielding agent is coated on the backside of the support and further a white pigment (for example, titanium dioxide, silicon dioxide, kaolin, zinc dioxide, and barium sulfate) is coated thereon for whitening. Further, a protective layer is preferably provided on the uppermost layer of these layers. A matting agent can be incorporated into this protective layer to improve adhesiveness and allow a writing property to be created.

Gelatin, cellulose ester and polyvinyl alcohol are used as the binder for the above described light shielding layer and protective layer.

A developing agent, a silver halide solvent, an alkali agent, and a color toning agent are present in the processing element used in the present invention. The developing agent and/or silver halide solvent can be incorporated into the light-sensitive element and/or image-receiving element depending on the purpose.

The developing agent used in the present invention is a benzene derivative in which at least two hydroxyl groups and/or amino groups are substituted at an ortho or para position of a benzene nucleus (for example, hydroquinone, amidol, methol, glycine, p-aminophenol, and pyrogallol), and hydroxylamines, particularly primary aliphatic N-substituted, secondary aliphatic N-substituted, aromatic N-substituted, or $\beta$-hydroxylamines. These are soluble in aqueous alkali, and examples include hydroxylamine, N-methylhydroxylamine, N-ethylhydroxylamine, the compounds described in U.S. Pat. No. 2,857,276, and N-alkoxyalkyl substituted-hydroxylamines described in U.S. Pat. No. 3,293,034.

Further, hydroxylamine derivatives having a tetrahydrofurfuryl group described in JP-A-49-88521 can be used as well.

Aminoreductones described in German Patent Applications (OLS) 2,009,054, 2,009,055, and 2,009,078, and heterocyclic amino-reductones described in U.S. Pat. No. 4,128,425 can be used as well.

Tetraalkylreductic acid described in U.S. Pat. No. 3,615,440 can also be used as well.

Phenidones, p-aminophenols and ascorbic acid are preferably used as a developing aid in combination with the above-described developing agents. Phenidones are preferably used in combination.

A conventional fixing agent (for example, sodium thiosulfate, sodium thiacyanate, ammonium thiosulfate, and the compounds described in U.S. Pat. No. 2,543,181), and the compounds in which cyclic imide and a nitrogen base are combined (the compound in which a barbiturate or uracil and ammonia or amine are combined, and combinations described in U.S. Pat. No. 2,857,274) can be used as a silver halide solvent. Further, 1,1-bis-sulfonylalkane and the derivatives thereof are known and can be used as silver halide solvents used in the present invention.

The processing composition contains alkalis, preferably alkali metal hydroxides, for example, sodium hydroxide or potassium hydroxide. The concentration of alkali is preferably 1N to 2.5N.

Where the processing composition is spread between the superposed light-sensitive element and image-receiving element in the form of a thin layer, the processing element contains preferably a polymer film-forming agent or thickener.

The polymer film-forming agent or thickener present in the processing element can be a cellulose derivative such as carboxymethyl cellulose, ethyl cellulose, hydroxyethyl cellulose, methyl cellulose, and hydroxypropyl cellulose, a vinyl polymer such as polyvinyl alcohol, an acrylic acid polymer such as polyacrylic acid and polymethacrylic acid, and an inorganic polymer such as water glass. Among them, hydroxyethyl cellulose and carboxymethyl cellulose are particularly preferred. These are incorporated into the processing composition in a concentration which is effective for providing a suitable viscosity conventional in diffusion transfer photographic method.

Further, the processing composition may contain the other auxiliaries conventionally known in a silver salt diffusion transfer method, for example, an anti-fogging agent and a stabilizer.

EXAMPLES

The present invention will be explained in greater detail below with reference to the following examples and comparative examples. Unless otherwise indicated, all parts percents, ratios and the like are by weight.

Example 1

1. Preparation of Image-Receiving Element:

The following layers were provided in order on a polyethylene-laminated paper support to prepare an image-receiving element. The numerals represent the coated amount in terms of g/m$^2$.

| | |
|---|---|
| (1) Neutralization Layer | |
| Cellulose acetate (acetylation degree: 55%) | 6.0 |
| Methylvinyl ether-maleic anhydride copolymer | 4.0 |
| Uvitex OB (manufactured by Ciba Geigy Co.) | 0.04 |
| 1-(4-Hexylcarbamoylphenyl)-2,3-dihydroxy-imidazole-2-thione | 0.25 |
| (2) Image Stabilizing Layer | |
| Cellulose acetate (acetylation degree: 46%) | 4.0 |
| Following compound | 2.0 |

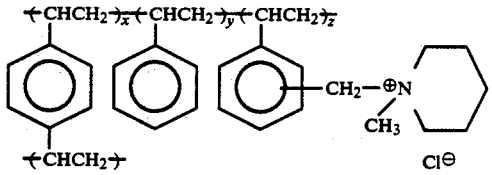

x:y:z = 5:47.5:47:5

| | |
|---|---|
| (3) Timing Layer | |
| Cellulose acetate (acetylation degree: 55%) | 8.0 |
| (4) Image-Receiving Layer | |
| Cellulose acetate (acetylation degree: 55%) | 2.0 |
| Palladium sulfide | $7.5 \times 10^{-4}$ |
| 1-(4-Hexylcarbamoylphenyl)-2,3-dihydroxy-imidazole-2-thione | $1.0 \times 10^{-2}$ |
| (5) Saponification | |
| The surface was subjected to saponification with a solution prepared by mixing sodium hydroxide 12 g, glycerin 24 g and methanol 280 ml and then washed. | |
| (6) Separating Layer | |
| Butyl methacrylate-acrylic acid copolymer (mole ratio 15:85) | 0.1 |
| (7) Back Layer | |
| A light shielding layer, a white color layer and a protective layer were coated on the backside of | |

-continued the above described support.

| | |
|---|---|
| (7-1) Light Shielding Layer | |
| Carbon black | 4.0 |
| Gelatin | 8.0 |
| (7-2) White Color Layer | |
| Titanium dioxide | 6.0 |
| Gelatin | 0.7 |
| (7-3) Protective Layer | |
| Polymethyl methacrylate grain (average diameter: 0.05 μm) | 0.2 |
| Gelatin | 1.6 |

2. Preparation of Light-Sensitive Element

The following layers were provided on a support (polyethylene terephthalate) to prepare a light-sensitive element. The numerals represent the coated amount in terms of g/m$^2$.

| | |
|---|---|
| (1) Colloidal Silver Layer | |
| Colloidal silver (average grain size: 0.01 μm) | 0.002 |
| Gelatin | 0.9 |
| (2) Light-Sensitive Layer | |
| Silver bromoiodide emulsion as silver (average grain size: 1.5 μm, AgI content: 6.0 mol %, uniform type structure) | 0.55 |
| 4-Hydroxy-6-methyl-1,3,3a,7-tetrazaindene | 0.01 |
| Compound (A) | $3.2 \times 10^{-4}$ |

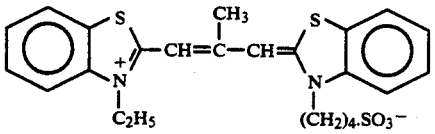

| | |
|---|---|
| Compound (B) | $3.2 \times 10^{-4}$ |

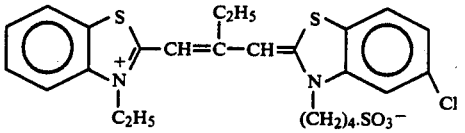

| | |
|---|---|
| Compound (C) | $1.2 \times 10^{-4}$ |

-continued

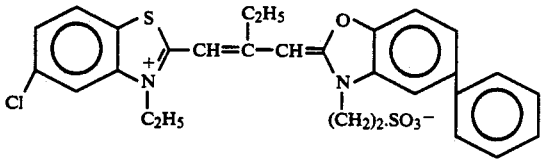

| | |
|---|---|
| Gelatin | 3.9 |
| (3) Protective Layer | |
| Gelatin | 0.7 |
| Polymethyl methacrylate grain (average grain size: 4.7 μm) | 0.1 |
| (4) Back Layer | |
| (4-1) Light Shielding Layer | |
| Carbon black | 4.0 |
| Gelatin | 2.0 |
| (4-2) Protective Layer | |
| Gelatin | 0.7 |
| Polymethyl methacrylate grain (average diameter: 0.05 μm) | 0.1 |

The above light-sensitive element was designated as (1A). Light-sensitive elements (1B) to (1L) were prepared in the same manner as for light-sensitive element (1A) except that the silver halide emulsion present in layer (2) was replaced with the emulsions shown in Table 1 below.

TABLE 1

| Emulsion | Halogen Composition | KI Addition Amount (mol %) Whole | Core | Shell 1 | Shell 2 | Core/Shell Ag Amount Ratio | Covering* Silver Amount | AgI |
|---|---|---|---|---|---|---|---|---|
| A (Comp.) | Even type | 6 | — | — | — | — | — | — |
| B (Comp.) | Even type | 3 | — | — | — | — | — | — |
| C (Comp.) | Core/shell | 3.5 | 5 | 2 | — | 50:50% | — | — |
| D (Comp.) | Core/shell | 3.3 | 0 | 6 | 6 | 45:5:50% | — | — |
| E (Inv.) | Core/shell | 3.5 | 0 | 70 | 0 | 45:5:50% | 5% | 5 mol % |
| F (Inv.) | Core/shell | 3.0 | 0 | 70 | 0.4 | 46:4:50% | 5% | 5 mol % |
| G (Inv.) | Core/shell | 2.7 | 0 | 90 | 0 | 47:3:50% | 5% | 5 mol % |
| H (Inv.) | Core/shell | 2.6 | 0.1 | 90 | 1.6 | 48:2:50% | 5% | 5 mol % |
| I (Inv.) | Core/shell | 3.0 | 0 | 90 | 1 | 67:3:30% | 5% | 5 mol % |
| J (Inv.) | Core/shell | 2.6 | 0.3 | 100 | 1 | 48:2:50% | 5% | 5 mol % |
| K (Inv.) | Core/shell | 3.0 | 0 | 100 | 0 | 47:3:50% | 7% | 3 mol % |
| L (Inv.) | Core/shell | 2.5 | 0 | ** | 0 | 50:0:50% | 5% | 5 mol % |

*After chemical sensitization

**Only KI solution was added in such an amount that the total AgI content became 2.5 mole %.

Emulsions (A) to (L) used for light-sensitive elements (1A) to (1L) were prepared in the following manner.

| Emulsion (A): | | |
|---|---|---|
| (a) | $H_2O$ | 1000 ml |
| | KBr | 6.6 g |
| | Gelatin | 16.7 g |
| (b) | $AgNO_3$ | 4.0 g |
| | $NH_4NO_3$ (50%) | 0.4 ml |
| | $H_2O$ | up to 30 ml |
| (c) | KBr | 2.63 g |
| | KI | 0.23 g |
| | $H_2O$ | up to 30 ml |
| (d) | Gelatin | 6.2 g |
| | $H_2O$ | 62 ml |
| (e) | KBr (30%) | 50 ml |
| (f) | $NH_4NO_3$ (50%) | 20 ml |
| (g) | NaOH (1 N) | 56 ml |
| (h) | $H_2SO_4$ (1 N) | 54 ml |
| (i) | KSCN (1 N) | 37.8 ml |
| (j) | $AgNO_3$ | 46.0 g |
| | $NH_4NO_3$ (50%) | 3.0 ml |
| | $H_2O$ | up to 276 ml |
| (k) | KBr | 30.3 g |
| | KI | 2.70 g |
| | $H_2O$ | up to 276 ml |
| (l) | $K_2IrCl_6$ (0.001%) | 2.0 ml |

-continued

| Emulsion (A): | | |
|---|---|---|
| (m) | $AgNO_3$ | 50.0 g |
| | $NH_4NO_3$ (50%) | 3.3 ml |
| | $H_2O$ | up to 300 ml |
| (n) | KBr | 32.9 g |
| | KI | 2.9 g |
| | $K_4[Fe(CN)_6]$ (0.1%) | 2.0 ml |
| | $H_2O$ | up to 300 ml |
| (o) | Gelatin | 37 g |

Solution (a) was placed in a tank and heated to 62° C. Then, solutions (b) and (c) were simultaneously added over a period of 1 minute and 15 minutes later, solution (d) was added to carry out physical ripening for 15 minutes. Subsequently, (e) was added to carry out physical ripening for 20 minutes, followed by further adding (f) and (g) to carry out physical ripening for 40 minutes. After physical ripening, (h) was added and 2 minutes later, the solutions (j) and (k) were simultaneously added over a period of 30 minutes. When 30% of solutions (j) and (k) had been added, solution (i) was added. Two minutes after finishing the addition of solutions (j) and (k), (l) was added and further 2 minutes later, solutions (m) and (n) were added simultaneously over a period of 20 minutes. Five minutes after finishing the addition, the temperature was reduced to 40° C. and a desalting process was repeated three times. Then, (o) was added and further $H_2O$ was added so that the total amount became 880 g. The pH was adjusted to 6.2 and the emulsion was redispersed. After the redispersion, the temperature was increased to 62° C. and the emulsion was subjected to an optimum chemical sensitization with sulfur and gold sensitizations using sodium thiosulfate, chlorauric acid and potassium thiocyanate.

Emulsion (B):

Emulsion (B) was prepared in the same manner as emulsion (A) except that the KI amount in (c), (k) and (n) was adjusted to 3%, respectively.

Emulsion (C):

Emulsion (C) was prepared in the same manner as emulsion (A) except that the compositions of (c), (k) and (n) were changed as follows:

| | | |
|---|---|---|
| (c) | KBr | 2.66 g |
| | KI | 0.20 g |
| | $H_2O$ | up to 30 ml |
| (k) | KBr | 30.6 g |
| | KI | 2.25 g |
| | $H_2O$ | up to 276 ml |
| (n) | KBr | 34.3 g |
| | KI | 0.98 g |
| | $K_4[Fe(CN)_6]$ (0.1%) | 2.0 ml |
| | $H_2O$ | up to 300 ml |

Emulsion (D):

| | | |
|---|---|---|
| (a) | $H_2O$ | 1000 ml |
| | KBr | 6.6 g |
| | Gelatin | 16.7 g |
| (b) | $AgNO_3$ | 4.0 g |
| | $NH_4NO_3$ (50%) | 0.4 ml |
| | $H_2O$ | up to 30 ml |
| (c) | KBr | 2.8 g |
| | $H_2O$ | up to 30 ml |
| (d) | Gelatin | 6.2 g |
| | $H_2O$ | 62 ml |
| (e) | KBr (30%) | 50 ml |
| (f) | $NH_4NO_3$ (50%) | 20 ml |
| (g) | NaOH (1 N) | 56 ml |
| (h) | $H_2SO_4$ (1 N) | 54 ml |
| (i) | KSCN (1 N) | 37.8 ml |
| (j) | $AgNO_3$ | 41.0 g |
| | $NH_4NO_3$ (50%) | 3.0 ml |
| | $H_2O$ | up to 276 ml |
| (k) | KBr | 28.7 g |
| | $H_2O$ | up to 276 ml |
| (l) | $AgNO_3$ | 5.0 g |
| | $NH_4NO_3$ (50%) | 0.3 ml |
| | $H_2O$ | up to 50 ml |
| (m) | KBr | 3.29 g |
| | KI | 0.29 g |
| | $H_2O$ | up to 50 ml |
| (n) | $K_2IrCl_6$ (0.001%) | 2.0 ml |
| (o) | $AgNO_3$ | 50.0 g |
| | $NH_4NO_3$ (50%) | 3.3 ml |
| | $H_2O$ | up to 300 ml |
| (p) | KBr | 32.9 g |
| | KI | 2.9 g |
| | $K_4[Fe(CN)_6]$ (0.1%) | 2.0 ml |
| | $H_2O$ | up to 300 ml |
| (q) | Gelatin | 37 g |

Solution (a) was placed in a tank and heated to 62° C. Then, solutions (b) and (c) were simultaneously added over a period of 1 minute and 15 minutes later, solution (d) was added to carry out physical ripening for 15 minutes. Subsequently, (e) was added to carry out physical ripening for 20 minutes, followed by further adding (f) and (g) to carry out physical ripening for 40 minutes. After the physical ripening, (h) was added and 2 minutes later, solutions (j) and (k) were simultaneously added over a period of 30 minutes. When 30% of solutions (j) and (k) had been added, solution (i) was added. Two minutes after finishing the addition of solutions (j) and (k), solutions (l) and (m) were added over period of 5 minutes and 2 minutes after finishing the addition, (n) was added. Further 2 minutes later, solutions (o) and (p) were simultaneously added over a period of 20 minutes. Five minutes after finishing the addition, the temperature was reduced to 40° C. and a desalting process was repeated three times. Then, (q) was added and further $H_2O$ was added so that the total amount became 880 g. The pH was adjusted to 6.2 and the emulsion was redispersed. After the redispersion, the temperature was increased to 62° C. and the emulsion was subjected to optimum chemical sensitization by sulfur and gold sensitizations using sodium thiosulfate, chlorauric acid and potassium thiocyanate.

Emulsion (E):

Emulsion (E) was prepared in the same manner as emulsion (D) except that the compositions of (m) and (p) were changed as follows:

| | | |
|---|---|---|
| (m) | KBr | 1.05 g |
| | KI | 3.42 g |
| | $H_2O$ | up to 50 ml |
| (p) | KBr | 35.0 g |
| | $K_4[Fe(CN)_6]$ (0.1%) | 2.0 ml |
| | $H_2O$ | up to 300 ml |

After chemical sensitization, the silver bromide fine grain emulsion (average grain size: 0.05 μm) in the proportion of 5% in terms of silver and KI (1%) 24.4 ml were added and then the emulsions was ripened at 62° C. for 40 minutes, whereby a silver bromoiodide phase was formed on a surface.

Emulsion (F):

Emulsion (F) was prepared in the same manner as emulsion (D) except that the compositions of (j) to (m) and (p) were changed as follows:

| | | |
|---|---|---|
| (j) | $AgNO_3$ | 42.0 g |
| | $NH_4NO_3$ (50%) | 3.0 ml |
| | $H_2O$ | up to 276 ml |
| (k) | KBr | 29.4 g |
| | $H_2O$ | up to 276 ml |
| | $AgNO_3$ | 4.0 g |
| | $NH_4NO_3$ (50%) | 0.3 ml |
| | $H_2O$ | up to 50 ml |
| (m) | KBr | 0.84 g |
| | KI | 2.74 g |
| | $H_2O$ | up to 50 ml |
| (p) | KBr | 34.9 g |
| | KI | 0.20 g |
| | $K_4[Fe(CN)_6]$ (0.1%) | 2.0 ml |
| | $H_2O$ | up to 300 ml |

After chemical sensitization, the silver bromide fine grain emulsion (average grain size: 0.05 μm) in a proportion of 5% in terms of silver amount and KI (1%) 24.4 ml were added and then the emulsion was ripened at 62° C. for 40 minutes, whereby a silver bromoiodide phase was formed on the surface.

Emulsion (G):

Emulsion (G) was prepared in the same manner as emulsion (D) except that the compositions of (j) to (m) and (p) were changed as follows:

| | | |
|---|---|---|
| (j) | $AgNO_3$ | 43.0 g |
| | $NH_4NO_3$ (50%) | 3.0 ml |
| | $H_2O$ | up to 276 ml |
| (k) | KBr | 30.1 g |
| | $H_2O$ | up to 276 ml |
| (l) | $AgNO_3$ | 3.0 g |
| | $NH_4NO_3$ (50%) | 0.3 ml. |
| | $H_2O$ | up to 50 ml |
| (m) | KBr | 0.21 g |
| | KI | 2.64 g |
| | $H_2O$ | up to 50 ml |
| (p) | KBr | 35.0 ml |
| | $K_4[Fe(CN)_6]$ (0.1%) | 2.0 ml |
| | $H_2O$ | up to 300 ml |

After chemical sensitization, the silver bromide fine grain emulsion (average grain size: 0.05 μm) in the proportion of 5% in terms of silver and KI (1%) 24.4 ml were added and then the emulsion was ripened at 62° C. for 40 minutes, whereby a silver bromoiodide phase was formed on the surface.

Emulsion (H):

Emulsion (H) was prepared in the same manner as emulsion (D) except that the compositions of (c), (j) to (m) and (p) were changed as follows:

| | | |
|---|---|---|
| (c) | KBr | 2.80 g |
| | KI | 0.004 g |
| | $H_2O$ | up to 30 ml |
| (j) | $AgNO_3$ | 44.0 g |
| | $NH_4NO_3$ (50%) | 3.0 ml |
| | $H_2O$ | up to 276 ml |
| (k) | KBr | 30.8 g |
| | KI | 0.04 g |
| | $H_2O$ | up to 276 ml |
| (l) | $AgNO_3$ | 2.0 g |
| | $NH_4NO_3$ (50%) | 0.3 ml |
| | $H_2O$ | up to 50 ml |
| (m) | KBr | 0.14 g |
| | KI | 1.76 g |
| | $H_2O$ | up to 50 ml |
| (p) | KBr | 34.5 g |
| | KI | 0.78 g |
| | $K_4[Fe(CN)_6]$ (0.1%) | 2.0 ml |
| | $H_2O$ | up to 300 ml |

After chemical sensitization, the silver bromide fine grain emulsion (average grain size: 0.05 μm) in the proportion of 5% in terms of silver and KI (1%) 24.4 ml were added and then the emulsion was ripened at 62° C. for 40 minutes, whereby a silver bromoiodide phase was formed on the surface.

Emulsion (I):

Emulsion (I) was prepared in the same manner as emulsion (D) except that the compositions of (j) to (m), (o) and (p) were changed as follows:

| | | |
|---|---|---|
| (j) | $AgNO_3$ | 63.0 g |
| | $NH_4NO_3$ (50%) | 3.0 ml |
| | $H_2O$ | up to 276 ml |
| (k) | KBr | 44.1 g |
| | KI | 2.64 g |
| | $H_2O$ | up to 50 ml |
| (l) | $AgNO_3$ | 3.0 g |
| | $NH_4NO_3$ (50%) | 0.3 ml |
| | $H_2O$ | up to 50 ml |
| (m) | KBr | 0.21 g |
| | KI | 2.64 g |
| | $H_2O$ | up to 50 ml |
| (o) | $AgNO_3$ | 30.0 g |
| | $NH_4NO_3$ (50%) | 3.3 ml |
| | $H_2O$ | up to 300 ml |
| p | KBr | 18.9 g |
| | KI | 2.93 g |
| | $K_4[Fe(CN)_6]$ (0.1%) | 2.0 ml |
| | $H_2O$ | up to 300 ml |

After chemical sensitization, the silver bromide fine grain emulsion (average grain size: 0.05 μm) in the proportion of 5% in terms of silver and KI (1%) 24.4 ml were added and then the emulsion was ripened at 62° C. for 40 minutes, whereby a silver bromoiodide phase was formed on the surface.

Emulsion (J):

Emulsion (J) was prepared in the same manner as emulsion (D) except that the compositions of (c), (j) to (m) and (p) were changed as follows:

| | | |
|---|---|---|
| (c) | KBr | 2.79 g |
| | KI | 0.01 g |
| | $H_2O$ | up to 30 ml |
| (j) | $AgNO_3$ | 44.0 g |
| | $NH_4NO_3$ (50%) | 3.0 ml |
| | $H_2O$ | up to 276 ml |
| (k) | KBr | 30.7 g |
| | KI | 0.13 g |
| | $H_2O$ | up to 276 ml |
| (l) | $AgNO_3$ | 2.0 g |
| | $NH_4NO_3$ (50%) | 0.3 ml |
| | $H_2O$ | up to 50 ml |
| (m) | KI | 1.95 g |
| | $H_2O$ | up to 50 ml |
| (p) | KBr | 31.5 g |
| | KI | 4.89 g |
| | $K_4[Fe(CN)_6]$ (0.1%) | 2.0 ml |
| | $H_2O$ | up to 300 ml |

After chemical sensitization, the silver bromide fine grain emulsion (average grain size: 0.05 μm) in the proportion of 5% in terms of silver and KI (1%) 24.4 ml were added and then the emulsion was ripened at 62° C. for 40 minutes, whereby a silver bromoiodide phase was formed on the surface.

Emulsion (K):

Emulsion (K) was prepared in the same manner as emulsion (D) except that the compositions of (j) to (m) and (p) were changed as follows:

| | | |
|---|---|---|
| (j) | $AgNO_3$ | 43.0 g |
| | $NH_4NO_3$ (50%) | 3.0 ml |
| | $H_2O$ | up to 276 ml |
| (k) | KBr | 30.1 g |
| | $H_2O$ | up to 276 ml |
| (l) | $AgNO_3$ | 3.0 g |
| | $NH_4NO_3$ (50%) | 0.3 ml |
| | $H_2O$ | up to 50 ml |
| (m) | KI | 2.93 g |
| | $H_2O$ | up to 50 ml |
| (p) | KBr | 35.0 g |
| | $K_4[Fe(CN)_6]$ (0.1%) | 2.0 ml |
| | $H_2O$ | up to 300 ml |

After chemical sensitization, the silver bromide fine grain emulsion (average grain size: 0.05 μm) in the proportion of 7% in terms of silver and KI (1%) 20.5 ml were added and then the emulsion was ripened at 62° C. for 40 minutes, whereby a silver bromoiodide phase was formed on the surface.

| Emulsion (L): | | |
|---|---|---|
| (a) | $H_2O$ | 1000 ml |
| | KBr | 6.6 g |
| | Gelatin | 16.7 g |
| (b) | $AgNO_3$ | 4.0 g |
| | $NH_4NO_3$ (50%) | 0.4 ml |
| | $H_2O$ | up to 30 ml |
| (c) | KBr | 2.8 g |
| | $H_2O$ | up to 30 ml |
| (d) | Gelatin | 6.2 g |
| | $H_2O$ | 62 ml |
| (e) | KBr (30%) | 50 ml |
| (f) | $NH_4NO_3$ (50%) | 20 ml |
| (g) | NaOH (1 N) | 56 ml |
| (h) | $N_2SO_4$ (1 N) | 54 ml |
| (i) | KSCN (1 N) | 37.8 ml |
| (j) | $AgNO_3$ | 46.0 g |
| | $NH_4NO_3$ (50%) | 3.0 ml |
| | $H_2O$ | up to 276 ml |
| (k) | KBr | 32.2 g |
| | $H_2O$ | up to 276 ml |
| (l) | KI | 2.44 g |
| | $H_2O$ | up to 200 ml |
| (m) | $K_2IrCl_6$ (0.001%) | 2.0 ml |
| (n) | $AgNO_3$ | 50.0 g |
| | $NH_4NO_3$ (50%) | 3.3 ml |
| | $H_2O$ | up to 300 ml |
| (o) | KBr | 35.0 g |
| | $K_4[Fe(CN)_6]$ (0.1%) | 2.0 ml |
| | $H_2O$ | up to 300 ml |
| (q) | Gelatin | 37 g |

Solution (a) was put in a tank and heated to 62° C. Then, solutions (b) and (c) were simultaneously added over a period of 1 minute and 15 minutes later, solution (d) was added to carry out physical ripening for 15 minutes. Subsequently, (e) was added to carry out physical ripening for 20 minutes, followed by further adding (f) and (g) to carry out physical ripening for 40 minutes. After physical ripening, (h) was added and 2 minutes later, solutions (j) and (k) were simultaneously added over a period of 30 minutes. When 30% of solutions (j) and (k) had been added, solution (i) was added. Two minutes after finishing the addition of solutions (j) and (k), solution (l) was added over a period of 5 minutes and 2 minutes later, (m) was added. Further 2 minutes later, solutions (n) and (o) were simultaneously added over a period of 20 minutes. Five minutes after finishing the addition, the temperature was reduced to 40° C. and a desalting process was repeated three times. Then, (p) was added and further $H_2O$ was added so that the total amount became 880 g. The pH was adjusted to 6.2 and the emulsion was redispersed. After the redispersion, the temperature was increased to 62° C. and the emulsion was subjected to optimum chemical sensitization with sulfur and gold sensitizations using sodium thiosulfate, chlorauric acid and potassium thiocyanate.

After chemical sensitization, the silver bromide fine grain emulsion (average grain size: 0.05 μm) in the proportion of 5% in terms of silver and KI (1%) 24.4 ml were added and then the emulsion was ripened at 62° C. for 40 minutes, whereby a silver bromoiodide phase was formed on the surface.

3. Preparation of Processing Solution and Manufacturing of Pod

The processing solution was prepared under a nitrogen current since it is oxidized by air. After the processing solution was prepared using the procedure shown in Table 2, it was placed in plurality of breakable vessels (pod) in an amount of 0.7 g per vessel, whereby a processing element was prepared.

TABLE 2

| | |
|---|---|
| Titanium dioxide | 5 g |
| Potassium hydroxide | 280 g |
| Uracil | 90 g |
| Sodium thiosulfate (anhydrous) | 1.0 g |
| Tetrahydropyrimidinethione | 0.2 g |
| 2,4-Dimercaptopyrimidine | 0.2 g |
| Sodium 3-(5-mercaptotetrazolyl) benzenesulfonate | 0.2 g |
| Potassium iodide | 0.3 g |
| Zinc nitrate $9H_2O$ | 40 g |
| Triethanolamine | 6 g |
| Hydroxyethyl cellulose | 45 g |
| N,N-bis(methoxyethyl) hydroxylamine (17% aqueous solution) | 250 g |
| 4-Methyl-4-hydroxymethyl-1-phenyl-3-pyrazolidinone | 3.0 g |
| $H_2O$ | 1266 ml |

4. Spreading Processing

Light-sensitive elements (1A) and (1L) were subjected to a gradational exposure at 16 lux (4800° K.) and 1/100 second via a continuous wedge and then the samples in which the above image-receiving elements and processing elements were combined were subjected to a spreading processing at 15° C., 25° C. and 35° C. so that the solution thickness became 35 μm. Then, the optical density of the image-receiving elements which are separated after 30 seconds (15° C. processing) and after 15 seconds (25° C. and 35° C. processings) was measured. The maximum density (Dmax) and sensitivity ($S_{0.6}$) at 25° C. were evaluated. Further, a temperature of use dependency was evaluated from the difference between in gradations at 15° C. and 35° C. The sensitivity ($S_{0.6}$) was represented by the logarithm of the reciprocal of the exposure at the density of the minimum density (Dmin)+0.6 in terms of a relative value. The temperature of use dependency was represented as the differences in the densities 1.5 and 0.3 at 15° C. from those at 35° C. The larger the values of Dmax and $S_{0.6}$ the more advantageous. On the contrary, the closer to 0 the temperature of use dependency was the more advantageous since the gradation change is small. The results obtained are shown in Table 3 below.

TABLE 3

| Sample No. | Emulsion | Maximum Density (Dmax) | Sensitivity ($S_{0.6}$) | Temp. Dependency D = 1.5 | Temp. Dependency D = 0.3 |
|---|---|---|---|---|---|
| 1A (Comp.) | A | 1.48 | 100 | −0.20 | +0.10 |

TABLE 3-continued

| Sample No. | Emulsion | Maximum Density (Dmax) | Sensitivity ($S_{0.6}$) | Temp. Dependency D = 1.5 | Temp. Dependency D = 0.3 |
|---|---|---|---|---|---|
| 1B (Comp.) | B | 1.60 | 90 | −0.25 | +0.13 |
| 1C (Comp.) | C | 1.67 | 95 | −0.20 | +0.13 |
| 1D (Comp.) | D | 1.56 | 105 | −0.21 | +0.15 |
| 1E (Inv.) | E | 1.86 | 155 | −0.09 | +0.08 |
| 1F (Inv.) | F | 1.80 | 170 | −0.07 | +0.06 |
| 1G (Inv.) | G | 1.84 | 185 | −0.06 | +0.06 |
| 1H (Inv.) | H | 1.81 | 200 | −0.04 | +0.06 |
| 1I (Inv.) | I | 1.80 | 190 | −0.04 | +0.05 |
| 1J (Inv.) | J | 1.82 | 205 | −0.05 | +0.05 |
| 1K (Inv.) | K | 1.86 | 195 | −0.04 | +0.04 |
| 1L (Inv.) | L | 1.88 | 200 | −0.05 | +0.04 |

As is apparent from the results summarized in Table 3 above, the transferred images obtained with light-sensitive elements (1E) to (1L) of the present invention showed excellent photographic performance in which the maximum densities (Dmax) and sensitivities ($S_{0.6}$) were high and the gradation changes depending on temperature of use were small.

While the invention has been described in detail and with reference to specific embodiments thereof, it will be apparent to one skilled in the art that various changes and modifications can be made therein without departing from the spirit and scope thereof.

What is claimed is:

1. A light-sensitive element processable in a silver salt diffusion transfer method comprising developing a light-sensitive element containing a light-sensitive silver halide emulsion layer subjected to an imagewise exposure with an alkaline processing element containing a silver halide solvent to convert at least a part of the unexposed silver halide present in the emulsion layer to a transferable silver complex salt, and transferring at least a part of the silver complex salt to an image-receiving element including a silver precipitate nucleus-containing image-receiving layer to form an image on the image-receiving element, wherein the silver halide grain present in the light-sensitive silver halide emulsion layer comprises silver bromoiodide or silver bromochloroiodide having the following characteristics (a), (b), (c) and (d):

(a) the grains comprise grains of a core, as a nucleus and a plurality of layers thereon as a shell;

(b) the amount of iodide present in forming the core is 0 to 1 mole %; the amount of iodide present in forming the first shell layer is 60 to 100 mole %; and the total amount of iodide present in forming the shell layers after the first shell layer is 0 to 2 mole %;

(c) the average silver iodide content of the entire grain including the core and shell is 0.5 to 4.5 mole %; and (d) silver bromoiodide having a silver iodide content of 2 to 8 mole % is deposited on the grain surface after chemical sensitization in an amount corresponding to 1 to 10% by weight (in terms of silver amount) of the silver halide grains formed before chemical sensitization.

2. The light-sensitive element according to claim 1, wherein the weight ratio of the core to the entire shell layers ranges from 80:20 to 20:80 in terms of silver amount.

3. The light-sensitive element according to claim 1, wherein the silver iodide content of the entire silver halide grains is 1.0 to 3.5 mol %.

4. The light-sensitive element according to claim 1, the silver chloride content of the entire silver halide grains is 1 mol % or less.

5. The light-sensitive element according to claim 1, wherein the core of the silver halide grains contains 0.5 mol % or less silver iodide.

6. The light-sensitive element according to claim 1, wherein the total thickness of the layers present on the silver halide emulsion layer side of the support is 0.5 to 8.0 μm.

* * * * *